United States Patent [19]

Comer

[11] 4,325,195

[45] Apr. 20, 1982

[54] SNOW THROWER

[75] Inventor: Robert C. Comer, Hopkins, Minn.

[73] Assignee: The Toro Company, Minneapolis, Minn.

[21] Appl. No.: 211,985

[22] Filed: Dec. 1, 1980

Related U.S. Application Data

[63] Continuation of Ser. No. 118,466, Feb. 4, 1980, abandoned, which is a continuation of Ser. No. 906,637, May 16, 1978, abandoned.

[51] Int. Cl.[3] ..... E01H 5/00

[52] U.S. Cl. ..... 37/43 D; 37/53

[58] Field of Search ..... 37/43 R, 43 D, 43 L, 37/53; 56/294, 249

[56] References Cited

U.S. PATENT DOCUMENTS

| | | | |
|---|---|---|---|
| 2,706,864 | 4/1955 | Kear | 37/43 R |
| 2,714,772 | 8/1955 | Erickson | 37/43 D |
| 2,919,504 | 1/1960 | Rubin | 37/43 D |
| 3,074,189 | 1/1963 | Phelps | 37/43 D |
| 3,673,773 | 7/1972 | Ferguson | 56/294 |
| 4,138,831 | 2/1979 | Chase | 37/43 D |
| 4,190,972 | 3/1980 | Berner | 37/43 D |

FOREIGN PATENT DOCUMENTS

| | | | |
|---|---|---|---|
| 164895 | 12/1949 | Austria | 37/43 D |
| 843101 | 7/1952 | Fed. Rep. of Germany | 37/43 D |

*Primary Examiner*—E. H. Eickholt

*Attorney, Agent, or Firm*—James W. Miller

[57] ABSTRACT

A snow thrower having an impeller which has forward facing blades which extend a short distance inward from the periphery of the impeller is disclosed. The impeller blades are substantially rigid during operation, and the impeller cooperates with two side walls and a continuous rear wall which form the active impeller housing. The continuous rear wall has a first portion whose cross section is a circular arc and generally follows the periphery of the impeller mounted within it. The rear wall has a second portion which extends forward and upward to define a substantially planar snow guiding surface which, in normal operation, guides the snow forwardly and upwardly as it leaves the area of interaction with the impeller.

3 Claims, 8 Drawing Figures

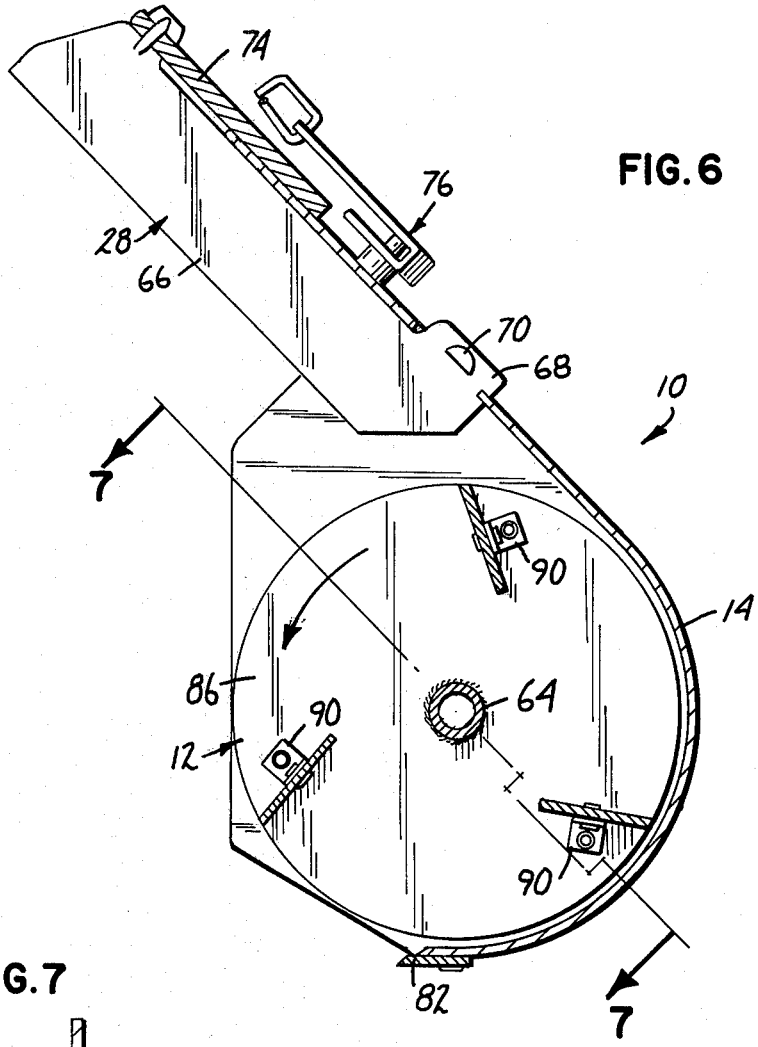
FIG. 6
FIG. 7
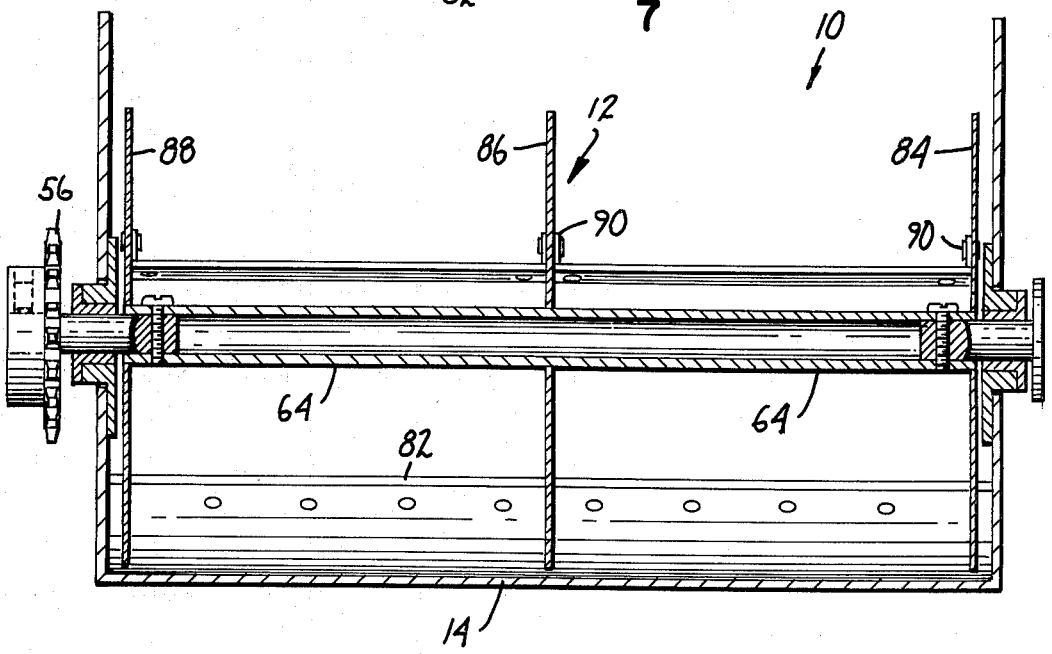

SNOW THROWER

This is a continuation of application Ser. No. 118,466, filed Feb. 4, 1980, which is itself a continuation of Ser. No. 906,637 filed May 16, 1978, both applications now abandoned.

BACKGROUND OF THE INVENTION

This invention generally relates to powered implements, and more specifically concerns an improved impeller for a snow thrower and an improved snow thrower incorporating the impeller for use in removal of snow from sidewalks, driveways and other areas in which snow clearance during the winter season is necessary.

Snow removal by means other than a simple manually powered snow shovel has been a problem which has been addressed for many years. Since snow removal is normally carried out at freezing or sub-freezing temperatures, and in conditions in which the user of snow removal equipment must deal with slipperiness of ground surface, and varying snow densities, the production of a simple, light-weight and effective snow thrower which will operate under these conditions and make the task of snow removal more manageable is a difficult one.

Practically speaking, since the slipperiness of the ground surface and difficulty of moving the snow thrower into the snow tend to make a snow thrower unwieldy and difficult to handle, there is considerable emphasis on and demand for a unit which is highly efficient in its use of power. This follows from the fact that the weight of the unit is directly related to the size of the power plant necessary to power it. This need is particularly strong in the smallest snow throwing units which are typically designed for metropolitan residential use, since the user desires a compact, lightweight implement which may be used in a way similar to the conventional manually operated snow shovel, but without the backwrenching effort of continually lifting the snow from the surface to be cleared and propelling it to an adjoining area.

The present invention is an improvement in snow thrower impellers and an improved snow thrower incorporating the newly developed impeller which appears to be more efficient, to operate more effectively in gust wind conditions, to require less power and, primarily because of these characteristics, to allow the construction of lighter weight and more maneuverable snow throwers, and also improving the performance of existing snow throwers into which the newly developed impeller is incorporated.

SUMMARY OF THE INVENTION

In accordance with the invention, the snow thrower impeller of the invention is of a generally cylindrical shape and is suitable for mounting for rotation about its longitudinal axis. The impeller includes a plurality of substantially rigid impeller blades. Each of the blades is of a width which is preferably one half the radius of the impeller. The blades are carried at the periphery of the impeller by blade carrying means which maintain the blades' substantial rigidity and their positions spaced from the axis of rotation of the impeller.

In some embodiments of the invention, the impeller will be placed in a single stage snow throwing implement in an impeller housing which has a rear wall in two sections. The first section generally follows the periphery of the impeller and cooperates with the impeller to force the snow to be propelled by the impeller blades rather than pushed away by them. The second portion of the rear wall extends upward and forward with respect to the ground surface and provides a guide for the snow as it comes off the lower section. Using the impeller of the present invention in combination with this type of housing, it has been found that an extremely cohesive discharge of snow from the snow thrower is produced. This discharge, by virtue of its cohesiveness, is less susceptible to wind gusts than the discharge of many snow throwers. In addition, it has been found that less power is required utilizing a snow thrower of the present invention, which permits use of a less powerful power source, and decreases the weight of the snow thrower constructed according to the present invention.

BRIEF DESCRIPTION OF THE DRAWINGS

Other objects and advantages of the invention will become apparent upon a reading of the following detailed description and upon reference to the drawings showing specific embodiments of the invention. Referring particularly to the drawings, wherein the use of like reference numerals throughout the several views denotes like elements:

FIG. 6 is a sectional view vertically through the housing of the thrower of FIG. 1 at a point approximately midway across the extent of the impeller;

FIG. 7 is a sectional view taken along the line 7—7 of FIG. 6; and

While the invention will now be described in connection with specific embodiments, it should be clear that the invention is not limited in scope to those embodiments. On the contrary, all alternatives, modifications and equivalents included within the spirit and scope of the invention as defined by the appended claims are covered.

DETAILED DESCRIPTION OF THE INVENTION

Figure 1:
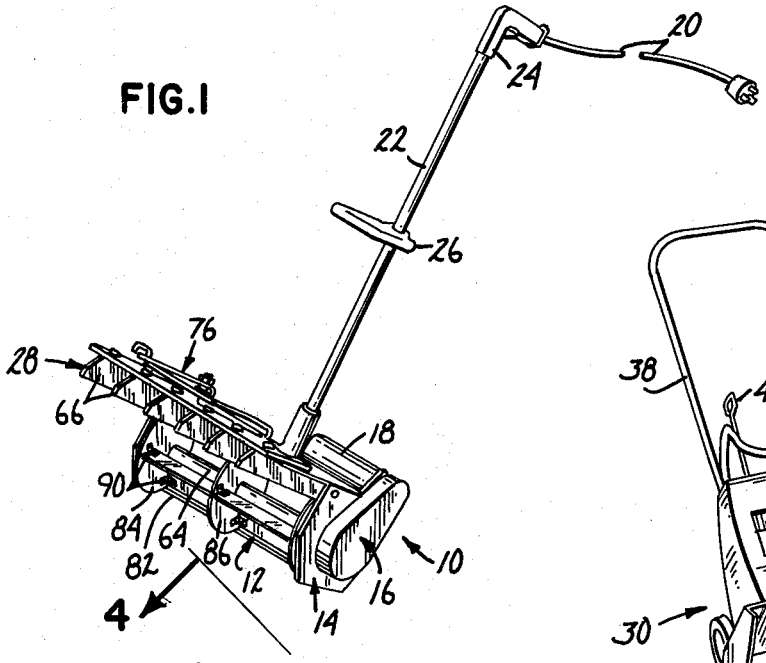
FIG. 1 is a perspective view of a small electrically powered snow thrower or power snow shovel constructed in accordance with the present invention, having a deflector structure to accomplish a sideward deflection of discharged snow.

In FIG. 1, a lightweight single stage snow thrower generally designated 10 is shown in perspective. A portion of the electrical cord for that snow thrower is shown cut away since the cord connection is not essential to the invention, and the cord may be of extended length. Snow thrower 10 has an impeller 12 which is housed within an impeller housing 14. At one end of impeller housing 14 is an impeller drive linkage and housing 16, which transfers power from an electric 18 to impeller 12. Power for electric motor 18 may be transmitted from a cord 20 through handle 22 to electric motor 18 to promote drive of impeller 12. Handle 22 has, at one end, a grip portion 24 which may contain a control switch controlling power to motor 18. Handle 22 may also be provided with an intermediate hand grip 26 fastened to handle 22 and adjustable along the length thereof to aid in operator control of the unit. In the particular embodiment shown in FIG. 1, the impeller housing is provided with a plurality of deflector vanes in a deflector vane assembly 28. These deflector vanes are for the purpose of guiding discharged snow to the right or left as it is forwardly discharged from the impeller housing. Details of the chain drive, the impeller and the vane deflector construction are shown in successive figures.

Figure 2:
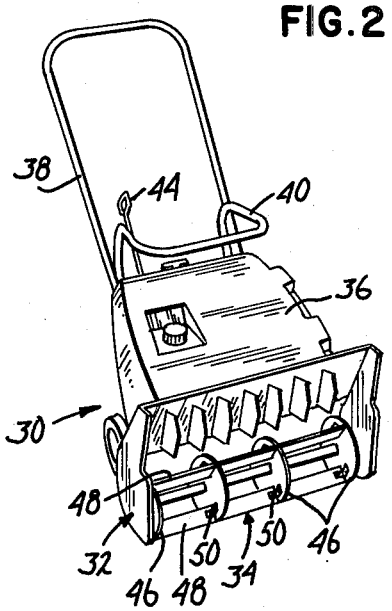
FIG. 2 is a perspective view of a single stage snow thrower constructed in accordance with the present invention.

FIG. 2 shows a snow thrower generally designated 30 which is a larger capacity snow thrower than that shown in FIG. 1. The effective width of operation of the snow thrower shown in FIG. 2 might be 20 inches, as an example, in comparison to a probable width of 12 or 14 inches for the unit as shown in FIG. 1. In addition, the unit of FIG. 2 is shown operated by a gas powered engine. The unit of FIG. 2 has an impeller housing 32 in which an impeller 34 is housed for rotation about a substantially horizontal axis. The unit also includes shrouding 36 which covers a gas powered engine used to drive the unit, a pair of handles 38, 40 for operator control of the unit, a deflector vane arrangement 42 for deflecting snow right or left of the unit during operation, and a deflector control mechanism terminating in a control handle 44 which controls the orientation of the deflector vanes. As appears clearly in FIG. 2, since it is desired to have the impeller blades substantially rigid during operation of the unit, the unit shown in FIG. 2 has more impeller blade mounting or support means 46, which in the embodiment shown take the form of substantially circular plates to which the impeller blades 48 are fastened by means of right angle tabs 50. The right angle tabs 50 are one means of making this reinforcing connection, but a large number of other alternatives for connection might as well be used. In one embodiment, the right angle tabs were fastened to both the impeller blades and the blade support means utilizing a riveted construction. As is illustrated by the embodiment of FIG. 2, the present invention, although it has specific advantages in relatively small snow throwing implements, is not limited to application to such implements, but might very well be incorporated in larger scale snow throwers.

Figure 3:
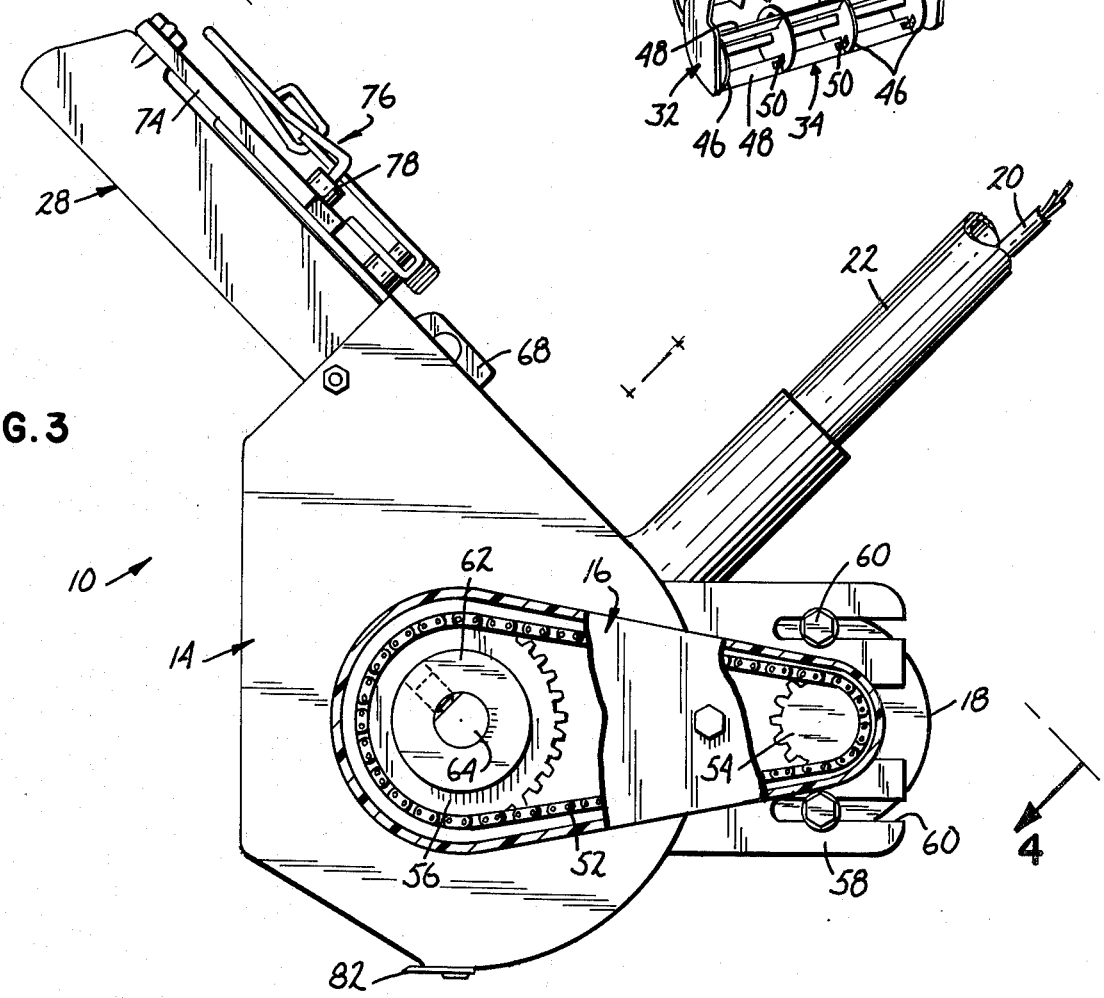
FIG. 3 is a side elevational view of a portion of the structure of the small snow thrower of FIG. 1, the handle portion thereof being partially cut away, and other portions being partially cut away to show the internal workings of the snow thrower.

FIGS. 3, 4, 6 and 7 illustrate details of the embodiment of FIG. 1 and of specific parameters which are preferred in an impeller constructed according to the present invention. FIG. 3 shows a portion of the cover of the drive train 16 cut away to reveal internal construction. In the embodiment shown in FIG. 3 drive occurs by means of a chain drive made up of a chain 52, a small drive sprocket 54 and a driven sprocket 56. Drive sprocket 54 is solidly affixed to the shaft of motor 18 to transmit driving motion from motor 18 to the chain drive system. As shown particularly in FIG. 3, impeller housing 14 is provided with motor mounting projections 58 on which motor 18 may be mounted by means of bolts 60. Ease of adjustment to maintain appropriate tension of the chain drive system is accomplished by means of bolts 60 in combination with a plurality of elongated slots which permit shifting of the position of drive sprocket 54 with respect to the impeller sprocket 56 to tighten or loosen the chain tension.

Driven sprocket 56 may have a hub 62 for mounting to a shaft 64 of impeller 12. In the particular embodiment shown in FIG. 3, hub 62 is adapted to receive a set screw which bears on a flat on shaft 64 so that the driven sprocket may transmit power through the chain drive system to impeller 12.

Figure 4:
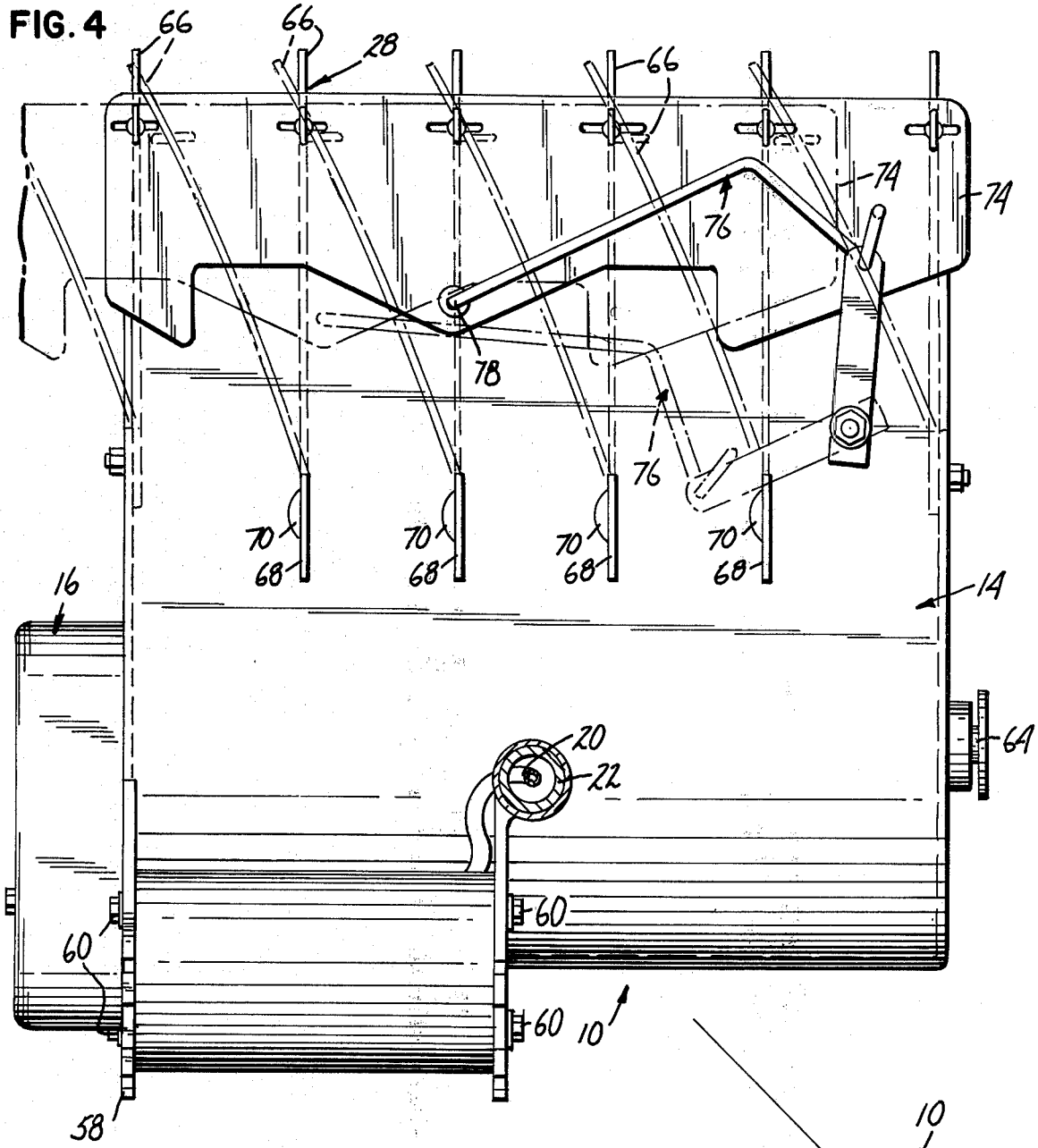
FIG. 4 is a rear elevational view of a portion of the snow thrower of FIG. 1, the view being taken generally along the line 4—4 of FIG. 3.

FIG. 4 is a rear view of the structure of FIG. 3 taken generally along the line 4—4 thereof. It illustrates the working of the deflector vane assembly 28. Deflector vane assembly 28 includes a plurality of flexible vanes 66, six of which are shown in the unit being described. FIG. 4 shows these vanes in two positions to illustrate the operation of the deflector vane assembly. The broken line position is a position which would establish a deflection to the left side of the snow thrower as viewed from the rear by an operator. Each of the deflector vanes 66 is fastened at a lower end to the housing by means of a tab 68 which extends through the rear wall of the housing. This is best seen in FIG. 6. Tabs 68 extend through slots in that rear wall and are secured by transversely extending projections 70 which may be inserted after the tabs 68 are placed through the slots, may be spring biased elements affixed to the slots, or any other suitable means of holding the lower edge of the vanes secure in the rear wall. The upper end of each of vanes 66 is attached by conventional means to a deflector plate 74 in a conventional manner. The deflector 74 is laterally movable with respect to the rear wall by means of a linkage generally designated 76. The linkage designated 76 is shown in two positions. The linkage pivots about a point 78 and establishes a left deflection, right deflection, and center position for the vanes to permit a forward and sideward deflection to be accomplished during snow throwing. This is particularly desirable when cleaning of the edge of a sidewalk abutting a lawn or other area not to be cleared is being accomplished.

Figure 5:
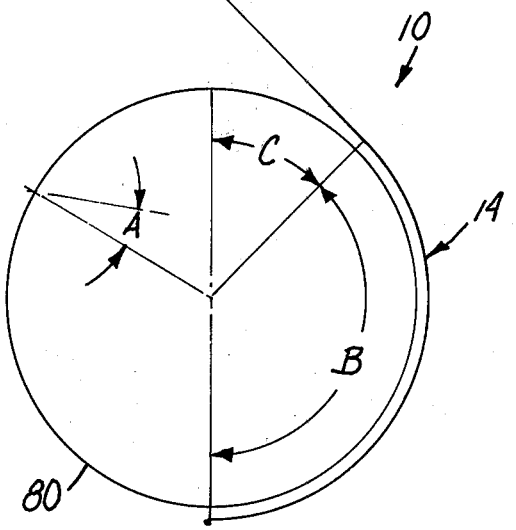
FIG. 5 is a diagramatic representation in side elevation of portions of an impeller and rear wall of an impeller housing showing important parameters of preferred embodiments of the present invention.

FIGS. 5, 6 and 7 particularly illustrate the structure of the impeller housing and the impeller built according to the present invention. FIG. 5 shows a circle 80 which represents the periphery of the rotating impeller blades. The impeller blades in an impeller built according to the present invention are preferably forward facing. As used in this specification and in the claims, "forward facing" means that their working surfaces, defined with respect to the direction of rotation, face inward with respect to a radial line from the center of the impeller. Stated another way, the leading edge of the impeller blade surface is at the periphery, and its trailing edge is swept back with respect to a radial line from the outermost point of the blade to the center of the impeller. The amount which the blade is forward facing may be defined with respect to the angle which the working surface of the impeller blade makes with a radial line to its leading edge. This is shown as angle A in FIG. 5. The preferred angle range has been found to be approximately 10° to 20°. Above 25°, the power required to drive the impeller effectively increases substantially in relation to any increases in capacity of the machine. Although the impeller may still be operable at angles below 5°, it is subject to the disadvantage of increased dribbling and scattering of snow, and a less cohesive throw pattern results. The angle B shown in FIG. 5 refers to the portion of the rear wall of the impeller housing which generally follows the periphery of the impeller. This is defined by the front edge of a scraper blade 82 shown particularly in FIG. 6, which may be riveted to the bottom of the impeller housing. It is preferable to have the angle B greater than 90° to allow a substantial interaction between the snow and the impeller blades prior to release of the snow from the impeller area of the housing. The angle C shown in FIG. 5 may be referred to as the take-off angle of the housing. It has been found that an angle of 45° between the point at which the housing rear wall is substantially tangent to the impeller periphery and the edge of the rear wall is preferred to effect substantial guiding of the snow. While a rear wall guide portion of greater extent might be used, the 45° angle is a preferred minimum figure when take off angle is fixed.

FIGS. 6 and 7 show details of the impeller construction. In the impeller shown, there are three blade support means or "spiders" 84, 86, 88, to which the impeller blades are fastened. They are fastened by means of tabs 90, which may be right angle tabs as shown, and, in one embodiment, rivets were used to fasten the impeller blades to the blade support means. The method of attachment of the blades to the spider or blade support means is not critical. However, it is preferable that there be sufficient blade support means or spiders so that the spans of the impeller blades are substantially rigid during operation of the snow thrower. As an example, a preferred material for the blades has been found to be Lexan ®, a plastic material of substantial durability and rigidity. In one embodiment of the invention in which an impeller using Lexan blades was constructed, it was found preferable to have two end support spiders and one intermediate spider across a 14 inch impeller width.

In the impeller as shown in FIGS. 6 and 7, a central shaft 64 provides the basic shaft about which the impeller is constructed. The shaft may be journaled in bearings carried by the side wall of the impeller housing, and the impeller blade support means or spiders may carry hubs for fastening to the shaft or may be welded thereto. The details of this part of the construction will be apparent to those of ordinary skill in the mechanical enginerring arts.

Testing and experimentation with impellers of the present invention have shown that, in a unit having a rotor with a five inch diameter, preferred results were obtained utilizing impeller blades with a $\frac{3}{4}$ inch to $1\frac{1}{4}$ inch width. Although extensive testing to establish a preferred proportion has not been undertaken, it is believed that the proportion of 1 to 4 between blade width and rotor diameter establishes an optimum value.

Also, in tests of a unit having an impeller with a five inch diameter and fourteen inch clearing width, the optimum range of rotor speeds has been found to be that which establishes a tangential speed between 2,000 and 4,000 feet per minute.

Figure 8:
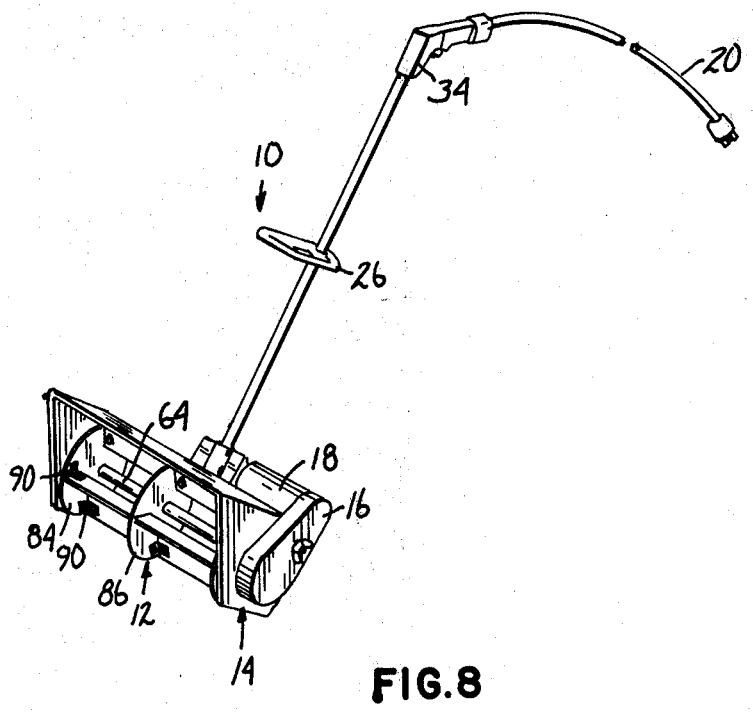
FIG. 8 is a perspective view of a power shovel constructed according to the present invention, the power shovel being electrically powered.

FIG. 8 shows an electrically powered shovel of the same general configuration of FIG. 1. The basic difference between the unit of FIG. 8 and that shown in FIG. 1 is that deflector vanes have not been incorporated in the unit of FIG. 8. Since the present invention allows use of a much lighter weight powered snow moving implement, it is possible to construct a power snow shovel which is used in a manner very similar to a conventional manually powered shovel. With such usage, vanes and the added weight which results from deflector vanes will not be necessary in some embodiments. It will be noted that in the rotor shown in each of the units, that is that of FIG. 1, FIG. 2 and FIG. 8, a three-bladed construction is used. The preferred impeller according to the present invention has three vanes. Two and four bladed rotors have been tried and are operative, but the preferable construction is with three forward facing vanes 120° apart about the periphery of the impeller.

In operation of the present invention, the impeller rotates in the direction shown in the arrow of FIG. 6 or a direction corresponding thereto, and the forward facing blades impact the snow to bite a portion of the snow with their leading edge and carry it into the impeller housing. As the snow is carried through the impeller housing it is accelerated by the blades and given both radial and tangential components of velocity. It is then released from the impeller, is guided by the takeoff portion and emerges from the impeller housing rear wall in a cohesive stream which is relatively impervious to wind gusts. Because of the improved efficiency of the unit, smaller power plants can be used, which makes a more maneuverable and less tiring unit available to the residential user.

From the foregoing, it will be apparent that an improved snow thrower providing lower power consumption and better performance has been provided. While the invention has been described in conjunction with specific embodiments, it is evident that a number of alternatives and modifications will be apparent to persons skilled in the art after reading the foregoing description. Accordingly, it is intended to embrace all such alternatives, modifications and variations which fall within the spirit and broad scope of the appended claims.

What is claimed is:

1. A lightweight snow thrower capable of use similar to that of a manually powered snow shovel, comprising in combination:

(a) a snow directing housing, including a rear wall having a first portion whose cross-section is substantially arcuate and a second discharge portion extending generally tangentially of said first portion, which second portion, in normal use of the snow thrower, extends obliquely upward and forward in the direction of snow to be cleared at approximately 45° relative to a horizontal line through said second portion to maximize the distance of throw for snow thrown along said second portion;

(b) an impeller mounted in said housing with a portion of the periphery thereof closely adjacent to said first portion, said impeller including a plurality of blades mounted at the periphery thereof and including an open volume to the interior of said impeller to permit air to pass through said impeller, each of said blades mounted to have a working surface which is angled inward with respect to the periphery of said impeller, wherein said inward angle on said blades is between 5° and 25° with respect to a radial line from an axis of rotation of the impeller to the outermost edge of said blades, and wherein said blade working surfaces are substantially planar to further maximize distance of throw;

(c) drive means cooperating with said impeller to provide rotary drive of said impeller in a direction to move snow along said rear wall from said first portion to said second portion; and (d) handle means fastened to the rear wall to enable an operator to maneuver the snow thrower, wherein the combined weight of said housing, impeller, drive means and handle means is sufficiently small so as to allow an operator to pick up the snow thrower and use the snow thrower by holding the snow thrower adjacent to the ground and by pushing the snow thrower in the manner of a manually powered snow shovel.

2. The snow thrower of claim 1, wherein said inward angle on said blades is between 10° and 20° with respect to a radial line from said axis to the outermost edge of said blades.

3. The snow thrower of claims 1 or 2, wherein said drive means drives said impeller at a tangential speed less than 4,000 feet per minute.

* * * * *